United States Patent [19]

Fiedler et al.

[11] Patent Number: 4,949,874

[45] Date of Patent: Aug. 21, 1990

[54] DEVICE FOR DISPENSING AT LEAST TWO FLOWABLE SUBSTANCES

[75] Inventors: Juergen Fiedler, Nettetal; Albert Stoeffler, Duesseldorf, both of Fed. Rep. of Germany

[73] Assignee: Henkel Kommanditgesellschaft auf Aktien, Duesseldorf, Fed. Rep. of Germany

[21] Appl. No.: 462,892

[22] Filed: Jan. 3, 1990

Related U.S. Application Data

[63] Continuation of Ser. No. 07/279,372, Dec. 2, 1988, abandoned.

[30] Foreign Application Priority Data

Dec. 4, 1987 [DE] Fed. Rep. of Germany ..... 3741086

[51] Int. Cl.[5] ..... B67D 5/60

[52] U.S. Cl. ..... 222/135; 222/144.5; 222/256; 222/383

[58] Field of Search ..... 222/94, 135–137, 222/144.5, 145, 130, 256, 266, 270, 275, 276, 278, 383, 384, 385, 380; 239/304, 305, 306

[56] References Cited

U.S. PATENT DOCUMENTS

| | | | |
|---|---|---|---|
| Re. 31,408 | 10/1983 | Czech et al. | 222/384 X |
| 3,269,605 | 8/1966 | Silver | 239/305 X |
| 3,720,352 | 3/1973 | Kozlowski | 222/131 |
| 3,760,986 | 9/1973 | Castner et al. | 222/145 X |
| 4,355,739 | 10/1982 | Vierkottor | 222/145 X |
| 4,366,919 | 1/1983 | Anderson | 222/137 |
| 4,438,871 | 3/1984 | Eckert | 222/380 X |
| 4,467,663 | 8/1984 | Schaeffer | 222/94 X |
| 4,511,068 | 4/1985 | Bossing | 222/257 |
| 4,598,843 | 7/1986 | Foster et al. | 222/260 X |
| 4,684,043 | 8/1987 | Foster et al. | 222/257 X |
| 4,711,375 | 12/1987 | Mader et al. | 222/135 |
| 4,773,562 | 9/1988 | Gueret | 222/135 |
| 4,826,048 | 5/1989 | Skorka et al. | 222/145 X |
| 4,846,371 | 7/1989 | Pfanstiel | 222/391 X |
| 4,846,373 | 7/1989 | Penn et al. | 222/137 |

FOREIGN PATENT DOCUMENTS

| | | | |
|---|---|---|---|
| 3729491A | 3/1988 | Fed. Rep. of Germany . | |
| 1418581 | 10/1965 | France | 222/136 |
| 7527527 | 4/1977 | France . | |
| 2501080 | 9/1982 | France | 222/137 |

*Primary Examiner*—Kevin P. Shaver

*Attorney, Agent, or Firm*—Ernest G. Szoke; Wayne C. Jaeschke

[57] ABSTRACT

A dispensing device for dispensing at least two flowable substances includes a container with two separate coaxial compartments for containing two flowable substances, respectively. Independently operable dosing units are associated with each compartment. Each dosing unit communicates with its associated compartment through a valve flap. Each dosing unit also includes a spring-actuated plunger guided in a cylinder, with a valving mechanism for enabling a predetermined quantity of the associated flowable substance to be selectively dispensed.

5 Claims, 1 Drawing Sheet

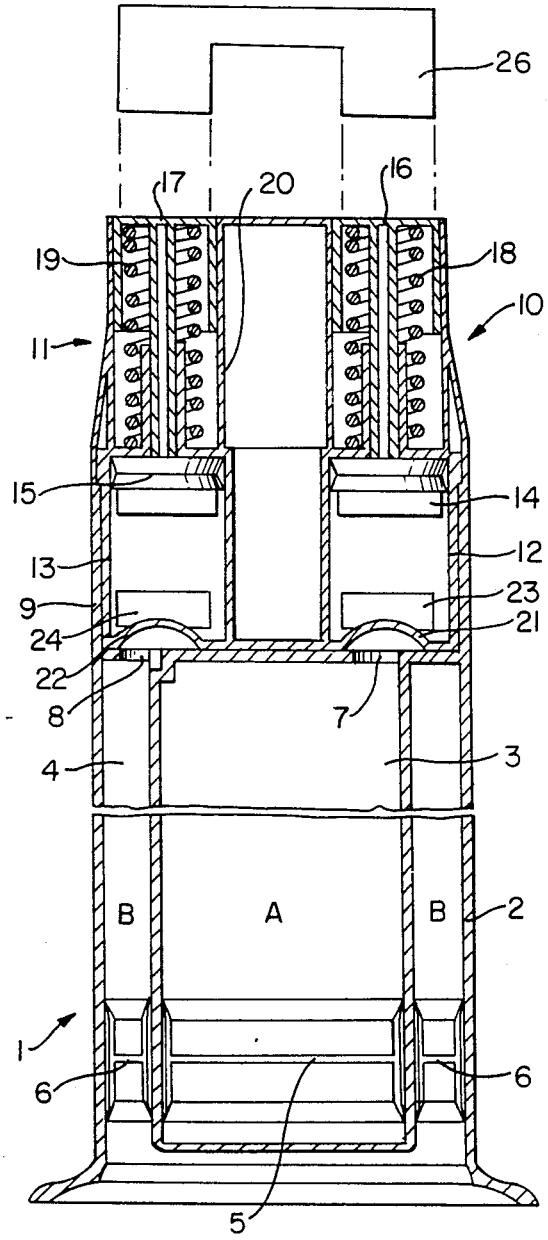
26
17
20
16
19
18
10
11
15
14
13
12
9
23
24
21
22
8
7
4
3
B
A
B
2
1
6
6
5

DEVICE FOR DISPENSING AT LEAST TWO FLOWABLE SUBSTANCES

This application is a continuation of application Ser. No. 07/279,372 filed on Dec. 2, 1988, now abandoned.

BACKGROUND

1. Field of the Invention

This invention relates generally to dispensig devices, and more particularly to such devices for selectively dispensing at least two flowable substances.

2. Discussion of Related Art

Devices of the type in the present field of the invention are known, for example, as soap or toothpaste dispensers. A certain quantity of flowable substance may readily be removed from the container by depression of a push-button integral therewith.

However, the disadvantage of these known devices is that only one substance (or mixture of substances) accommodated in the container can be dispensed, so that several containers are required for dispensing several substances (for example, two-component adhesives).

Although it is known that two tube-like devices for toothpaste can be arranged adjacent one another on a stand, this arrangement is unstable because, on removal of one toothpaste tue, the stand holding the other tube can easily fall over.

SUMMARY OF THE INVENTION

Accordingly, an object of the present invention is to provide a solution which, in one embodiment, enables several flowable substances to be dispensed more conveniently, and in a further embodiment, also simultaneously in certain mixing ratios from only one dispensing device.

According to the invention, this object is basically achieved with a device of the type mentioned at the beginning in that the container includes at least two separate compartments for at least two flowable substances, respectively, with one dosing unit for each compartment communicating therewith through a valve flap associated with a spring-actuated plunger guided in a cylinder.

According, several flowable substances—depending on the number of compartments in the container—may be conveniently dispensed separately from one another using only one device without any danger of the device falling over when only one substance is removed.

The safe handling is advantageously improved by the fact that the container is cylinder in shape and the chambers are arranged concentrically in the container. A container such as this is particularly easy to handle, in addition to which the relatively large base area of the container and the weight of the flowable substances provide for particularly high stability.

In another advantageous embodiment of the invention, the two dosing unit are coupled with one another by a common push-buttom. By depression of this push-button, both substanaces are simultaneously dispensed separately from one another.

In this embodiment, it can be of particular advantage that the ratio between the diameters of the two cylinders guiding the plungers is designed to correspond to the desired mixing ratio between the two flowable substances. This ensures that, when the common push-bottom is depressed, the two flowable substances are always automatically dispensed in the same ratio to one another, which is particularly advantageous in the case of two-component systems because this rules out sources of error in dispensing the substance.

BRIEF DESCRIPTION OF THE DRAWING

The invention is described by way of example in the following with reference to the accompanying schematic drawing which is a longitudinal section through one embodiment and in which like items are identified by the same reference number.

DETAILED DESCRIPTION OF THE INVENTION

The present dispensing device 1 comprises a cylindrical container 2 and two concentric compartments 3 and 4 for two flowable substances A and B. The two compartments 3 and 4 are closed in a pressure-tight manner at their lower ends by closure plungers 5 and 6. At their opposite end, the two compartments 3 and 4 each comprise an outlet opening 7, 8.

Above the openings 7 and 8, the container 2 continues into a cylindrical region 9 into which two dosing units 10 and 11 are introduced. Each dosing unit 10, 11 consisits of a cylinder 12, 13, a plunger 14, 15 guided therein with a push-button 16, 17, respectively. The plungers 14, 15 are individually actuated by helical springs 18, 19, which at one end, bear against an associated inside top face of a push-button 16, 17, respectively, and at their other ends, against a head piece 20 fixedly connected to the cylindrical region 9 of the container 2.

The compartments 3 and 4 communicate through the openings 7 and 8 with the cylinders 12 and 13, respectively. The openings 7 and 8 are closed by valve flaps 21, 22 of valves 23, 24, respectively, and only open when there is an excess pressure in the compartments 3, 4 in relation to the cylinders 12 and 13, respectively.

The operation of the device according to the preferred embodiment of the invention will now be described. In the starting position, the flowable substances A and B are present in the compartments 3 and 4 of the container 2 while the cylinders 12 and 13 are filled with air. If, for example push-button 16 is depressed, the air inn the cylinder 12 is forced out of the cylinder 12 into the surrounding atmosphere through an outlet (not shown) associated with the valve 23 by the plunger 14, by means not shown in the drawing. The plunger 14 is then moved back into its starting position by a retraction of the helical spring 18, causing a reduced pressure to be established in the cylinder 12 after closure of valve 23. Under the effect of this reduced pressure, the valve flap 21 is opened, causing substance A to be drawn from compartment 3 into cylinder 12. When pressure equalization between the cylinder 12 and the compartment 3 has taken place, the valve flap 23 closes again. If the push-button 16 is subsequently actuated again, the substance A is dispensed into the surrounding space through an outlet (not shown) associated with valve 23 by the plunger 14. In a similar manner, substance B is dispensed through an outlet (not shown) associated with valve 24 via plunge 15 being successively reciprocated via pushbutton 17.

If the two substances A and B are to be dispensed at the same time (as, for example, in the case of two-component adhesive), another embodiment of the invention provides for the two push-buttons 16 and 17 to be connected to one another by a common pressure plate 26, attached thereto in a conventional manner, although this has not been shown in the drawing. If this common pressure plate 26 is actuated, pressure is applied simultaneously to the two plungers 14 and 15 so that both substances A and B are simultaneously dispensed. To obtain a certain mixing ratio between the two substances A and B, the diameters of the cylinder 12 and 13 are designed to bear a corresponding ratio to one another so that the two substances A and B are automatically dispensed in the desired mixing ratio.

The invention is not confined to the embodiments illustrated. Further embodiments of the invention are possible without departing from the basic concept. Thus, more than two compartments and dosing units for further components can be provided, and so forth.

What is claimed is:

1. A device for dispensing at least two flowable substances, comprises:

a container;

at least two individually operable dosing units in an upper portion of said container;

at least two separate compartments, one enclosing the other, in a lower portion of said container for receiving at least two flowable substances, respectively, for unpressurized containment therein, said compartments each including an opening into one of said dosing units, respectively;

said dosing units each being associated with an individual one of said compartments, respectively, each one of said dosing units including independent means for selectively withdrawing and dispensing a predetermined amount of associated flowable substance from their associated compartment;

said dosing units each including;

a cylinder;

a spring-biased plunger guided within said cylinder;

valving means within said cylinder including a valve flap located in the bottom of said cylinder, and immediately below said plunger, for sealing off an opening into an associated one of said compartments upon a downstroke of said plunger, for opening upon an upstroke of said plunger for allowing flowable substance to flow from said associated compartment into said cylinder, and permitting the dispensing of said flowable substance out of said cylinder to a user;

the outermost one of said compartments including an opening at an inner circumferential edge proximate a wall common with the innermost compartment, with the opening being immediately below the associated valve flap of the associated said cylinder; and the innermost one of said compartments including an opening at an outer circumferential edge proximate a wall common with said outermost compartment, with the opening being immediately below the associated valve flap of the associated said cylinder.

2. The dispensing device of claim 1, wherein said container is cylindrically shaped, and said compartments are arranged concentrically within said container.

3. The dispensing device of claim 1, further including a pressure plate bridgedly connected between said dosing units for in unison pushing said plungers of each one of said dosing units downward in their respective cylinders, whereafter upon release of said common pushbutton, the spring biasing of said plungers returns each to their rest positions.

4. The dispensing device of claim 1 wherein said independent means of said dosing units each further include a push-button for pushing the associated said plunger downward in its said cylinder, whereafter the spring biasing returns said plunger to its rest position upon release of said push-button.

5. The dispensing device of claim 4, wherein the ratio between the diameters of said cylinders corresponds to a desired and predetermined mixing ratio between said flowable substances.

* * * * *